US009814913B2

(12) United States Patent
Blomberg

(10) Patent No.: US 9,814,913 B2
(45) Date of Patent: Nov. 14, 2017

(54) RESPIRATOR WITH FLOATING ELASTOMERIC SLEEVE

(71) Applicant: 3M INNOVATIVE PROPERTIES COMPANY, St. Paul, MN (US)

(72) Inventor: David M. Blomberg, Lino Lakes, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 366 days.

(21) Appl. No.: 14/081,396

(22) Filed: Nov. 15, 2013

(65) Prior Publication Data

US 2015/0136142 A1 May 21, 2015

(51) Int. Cl.

| | |
|---|---|
| ***A62B 7/10*** | (2006.01) |
| ***A62B 18/00*** | (2006.01) |
| ***A62B 18/02*** | (2006.01) |
| ***A62B 18/08*** | (2006.01) |
| ***A62B 19/00*** | (2006.01) |
| ***A62B 9/04*** | (2006.01) |
| *A62B 23/02* | (2006.01) |

(52) U.S. Cl.

CPC ..... *A62B 7/10* (2013.01); *A62B 9/04* (2013.01); *A62B 18/006* (2013.01); *A62B 18/025* (2013.01); *A62B 18/08* (2013.01); *A62B 19/00* (2013.01); *A62B 23/02* (2013.01)

(58) Field of Classification Search

CPC ..... A61M 16/06; A61M 16/0627; A61M 16/105; A62B 7/10; A62B 9/04; A62B 18/02; A62B 18/025; A62B 18/08; A62B 19/00; A62B 23/02

USPC ..... 128/201.17, 201.22, 201.23, 201.25, 128/202.27, 205.25, 205.27, 205.29, 128/206.12, 206.17, 206.18, 206.21, 128/206.28, 207.13, 863; 220/213, 216, 220/221, 226, 254.7, 304, 796–798, 801, 220/805, 806, FOR. 105; 285/304, 345

See application file for complete search history.

(56) References Cited

U.S. PATENT DOCUMENTS

| | | | |
|---|---|---|---|
| 2,055,853 | A | 9/1936 | Schwartz |
| 2,062,834 | A | 12/1936 | Schwartz |
| 2,235,624 | A | 3/1941 | Schwartz |

(Continued)

FOREIGN PATENT DOCUMENTS

| | | |
|---|---|---|
| EP | 2017508 | 9/2013 |
| KR | 10-0773460 B1 | 11/2007 |

(Continued)

OTHER PUBLICATIONS

Koken Particulate Respirators webpage, http://www.koken-ltd.co.jp/english/particulaterespirators.htm, obtained from internet on Jun. 3, 2013.

(Continued)

*Primary Examiner* — Lynne Anderson
*Assistant Examiner* — Joseph D Boecker

(57) ABSTRACT

A respirator device having an elastomeric sleeve is provided. In an exemplary embodiment, a respirator device as described herein includes a body including a receiver having an elastomeric sleeve and a filter cartridge that includes a rigid nozzle element. The elastomeric sleeve defines a channel, and the elastomeric sleeve is configured to deform around the nozzle element when the nozzle element is inserted into the channel.

21 Claims, 6 Drawing Sheets

(56) References Cited

U.S. PATENT DOCUMENTS 2,241,535 A * 5/1941 Boothby ..... A62B 18/00 128/205.17
2,684,066 A * 7/1954 Glidden ..... A62B 9/02 128/201.15
2,787,333 A 4/1957 Boone
4,562,837 A 1/1986 Schlobohm
4,809,868 A * 3/1989 Pomroy ..... B65D 43/0218 220/260
4,921,512 A 5/1990 Maryyanek
4,932,399 A 6/1990 Cappa
5,062,421 A 11/1991 Burns
5,086,768 A 2/1992 Niemeyer
5,148,803 A * 9/1992 Schlobohm ..... A62B 18/025 128/205.27
RE35,062 E 10/1995 Brostrom
5,505,197 A * 4/1996 Scholey ..... A62B 18/00 128/202.27
5,515,846 A 5/1996 Drews
5,579,761 A * 12/1996 Yuschak ..... A62B 23/02 128/201.25
5,611,925 A 3/1997 Yasue
5,647,356 A 7/1997 Osendorf
5,666,949 A 9/1997 Debe
5,669,375 A 9/1997 Dahrendorf
5,799,813 A * 9/1998 Letica ..... B65D 17/506 220/254.1
6,216,693 B1 4/2001 Rekow
6,298,849 B1 * 10/2001 Scholey ..... A62B 7/10 128/205.27
6,488,319 B2 * 12/2002 Jones ..... F16L 37/0845 285/104
6,550,479 B1 4/2003 Duxbury
6,575,165 B1 6/2003 Cook
6,701,925 B1 * 3/2004 Resnick ..... A62B 17/04 128/201.22
6,761,169 B2 7/2004 Eswarappa
6,793,702 B2 9/2004 Eswarappa
7,101,412 B2 9/2006 Gossweiler
7,419,526 B2 9/2008 Greer
2001/0013347 A1 8/2001 Rekow
2002/0195109 A1 12/2002 Mittelstadt
2003/0029454 A1 * 2/2003 Gelinas ..... A62B 18/025 128/205.27
2003/0036735 A1 * 2/2003 Jepson ..... A61M 39/045 604/247
2003/0200969 A1 * 10/2003 Kintzel ..... A62B 18/08 128/206.12
2003/0217752 A1 11/2003 Muller
2004/0003810 A1 1/2004 Templeton
2004/0240940 A1 * 12/2004 Ericksen ..... F16L 37/008 405/40
2005/0126572 A1 6/2005 Gosweiler
2009/0160179 A1 * 6/2009 Ericksen ..... F16L 37/008 285/24
2009/0250060 A1 * 10/2009 Hacke ..... A61M 16/06 128/205.12
2010/0218761 A1 * 9/2010 Flannigan ..... A62B 18/025 128/201.19
2011/0023874 A1 * 2/2011 Bath ..... A61M 16/0066 128/202.22
2012/0000465 A1 1/2012 Cavaliere
2012/0024289 A1 2/2012 Johnstone
2012/0174922 A1 * 7/2012 Virr ..... A61M 16/0066 128/203.12
2012/0217742 A1 * 8/2012 Furuya ..... F16L 37/0915 285/345
2012/0260920 A1 * 10/2012 Choi ..... A62B 18/025 128/206.12
2013/0341904 A1 * 12/2013 Lehmann ..... F16L 37/22 285/33
2014/0216475 A1 * 8/2014 Blomberg ..... A62B 9/04 128/863
2014/0224256 A1 * 8/2014 Skov ..... A62B 18/02 128/206.17
2017/0021203 A1 * 1/2017 Baker ..... A62B 19/00

FOREIGN PATENT DOCUMENTS

WO WO 02/093045 11/2002
WO 03/041801 5/2003
WO WO 03/090873 A1 11/2003
WO WO 2008/082415 7/2008

OTHER PUBLICATIONS

International Application PCT/US2014/064970 Search Report dated Feb. 27, 2015.

* cited by examiner

RESPIRATOR WITH FLOATING ELASTOMERIC SLEEVE

TECHNICAL FIELD

This disclosure relates to a respirator device, in particular a respirator device including a receiver having an elastomeric sleeve configured to deform around a nozzle element.

BACKGROUND

Respiratory protection devices commonly include a mask body and one or more filter cartridges that are attached to the mask body. The mask body is worn on a person's face, over the nose and mouth, and may include portions that cover the head, neck, or other body parts in some cases. Clean air is made available to a wearer after passing through filter media disposed in the filter cartridge. In negative pressure respiratory protection devices, air is drawn through a filter cartridge by a negative pressure generated by a wearer during inhalation. In powered air devices, a fan or other powered unit may assist in delivering air to a user. Air from the external environment passes through the filter medium and enters an interior space of the mask body where it may be inhaled by the wearer.

Various techniques have been used to attach filter cartridges or elements to a respirator. Filter cartridges are commonly connected to an inlet port of a mask body via a threaded engagement, bayonet engagement, or other engagement, for example. In the case of dual cartridge respiratory protection devices, in which two cartridges are provided to filter air for a wearer, the filter cartridges are often connected to air inlets located proximate each cheek portion of the mask, away from a central portion of the mask, such that the cartridges extend outward at sides of the wearer's head. Inhalation check valves are commonly provided for each air inlet, such that air may be delivered from the filter cartridge into the breathing zone through the air inlet away from a central portion, and proximate each cheek portion of the mask body for example.

SUMMARY

The present disclosure provides a device including a body having a receiver, the receiver including an elastomeric sleeve, and a rigid nozzle element having an outer surface. The elastomeric sleeve defines a channel, and the elastomeric sleeve is configured to deform around the outer surface of the nozzle element when the nozzle element is inserted into the channel.

The present disclosure further provides a respirator device including a body and a filter cartridge. The body includes a filter cartridge receiver and an elastomeric sleeve having outer surface and an inner surface defining a channel. The filter cartridge includes a rigid nozzle element having an outer surface. At least a portion of the outer surface of the elastomeric sleeve does not contact a rigid component, and the elastomeric sleeve is configured to expand around the outer surface of the nozzle element when the nozzle element is inserted into the channel.

The above summary is not intended to describe each disclosed embodiment or every implementation. The Figures and the Detailed Description, which follow, more particularly exemplify illustrative embodiment

BRIEF DESCRIPTION OF DRAWINGS

The disclosure may be further explained with reference to the appended Figures, wherein like structure is referred to by like numerals throughout the several views, and wherein.

While the above-identified figures set forth various embodiments of the disclosed subject matter, other embodiments are also contemplated. In all cases, this disclosure presents the disclosed subject matter by way of representation and not limitation. It should be understood that numerous other modifications and embodiments can be devised by those skilled in the art which fall within the scope and spirit of the principles of this disclosure.

DETAILED DESCRIPTION

The present disclosure provides a respirator device that includes a body including a receiver and a rigid nozzle element. The receiver includes an elastomeric sleeve defining a channel. When the nozzle element is inserted into the channel of the elastomeric sleeve, the elastomeric sleeve deforms around an outer surface of the nozzle element to form a seal around the nozzle. A filter cartridge, for example, may thus be easily coupled to the body while providing a robust seal that prevents ingress of unwanted contaminants and debris.

Figure 1:
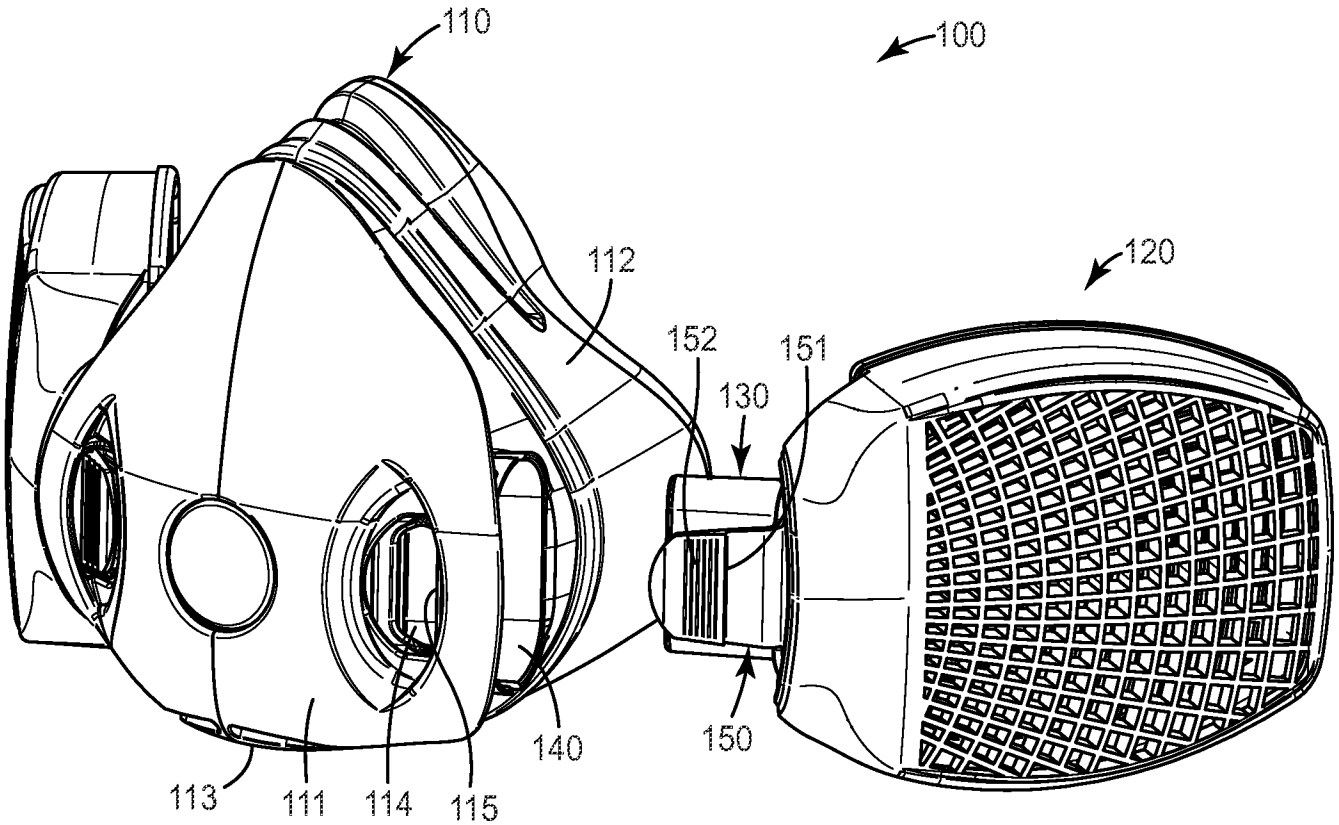
FIG. 1 is a perspective view of an exemplary respirator device according to the present disclosure.

FIG. 1 is a perspective view of an exemplary respirator device 100 including a disengaged filter cartridge 120. Exemplary respirator device 100 may be a half mask respirator that may be worn by a user to cover the nose and mouth and define an interior air space. Respirator device 100 includes a body 110, such as a mask body, and one or more filter cartridges 120 located on opposed sides of body 110. Body 110 includes one or more receivers 140, for example on opposed sides of body 110, configured to receive a portion of filter cartridge 120. Body 110 and filter cartridges 120 may be fluidically coupled such that receivers 140 cooperate with filter cartridges 120 to form an airflow channel between filter cartridges 120 and body 110. In other exemplary embodiments, body 110 may be a housing or component of a powered air respirator device, such as a powered air purifying respirator, or a head mounted respirator device body, and/or receiver may be fluidically coupled with a hose or other air delivery component.

Body 110 can include one or more rigid portions 111 and an elastomeric face contacting portion 112. An exhalation valve 113 may be positioned on body 110 to allow exhaled air to be purged from an interior air space. Respirator device 100 may also include a harness assembly (not shown) that is able to support body 110 on a user's head.

Filter cartridge 120 may be secured to body 110 and/or receiver 140 by one or more latches, threads, connectors, or other suitable complementary features known in the art. In an exemplary embodiment, respirator device 100 includes a cantilever latch 150 that secures filter cartridge 120 and/or nozzle element 130 to receiver 140. In the embodiment of FIGS. 1 through 5, cantilever latch 150 is integral to filter cartridge 120 and is substantially parallel or co-extending with a nozzle element 130. Receiver 140 or body 110 include an opening 114 and/or mating surface 115 that cooperates with cantilever latch 150 to provide a secure mechanical connection between body 110 and filter cartridge 120.

Cantilever latch 150 includes one or more features to facilitate engagement with body 110. In an exemplary embodiment, cantilever latch 150 includes an anchoring protrusion 151 and a push button 152 located along a length, or in some embodiments a distal end, of cantilever latch 150. Anchoring protrusion 151 may be configured to cooperate with mating surface 115 to assist in securing filter cartridge 120 to body 110. Push button 152 is configured to detach filter cartridge 120 from body 110. A user can apply force or pressure to push button 152 to deflect cantilever latch 150 and detach anchoring protrusion 151 from mating surface 115. Filter cartridge 120 may then be disengaged or removed from receiver 140.

Figure 2:
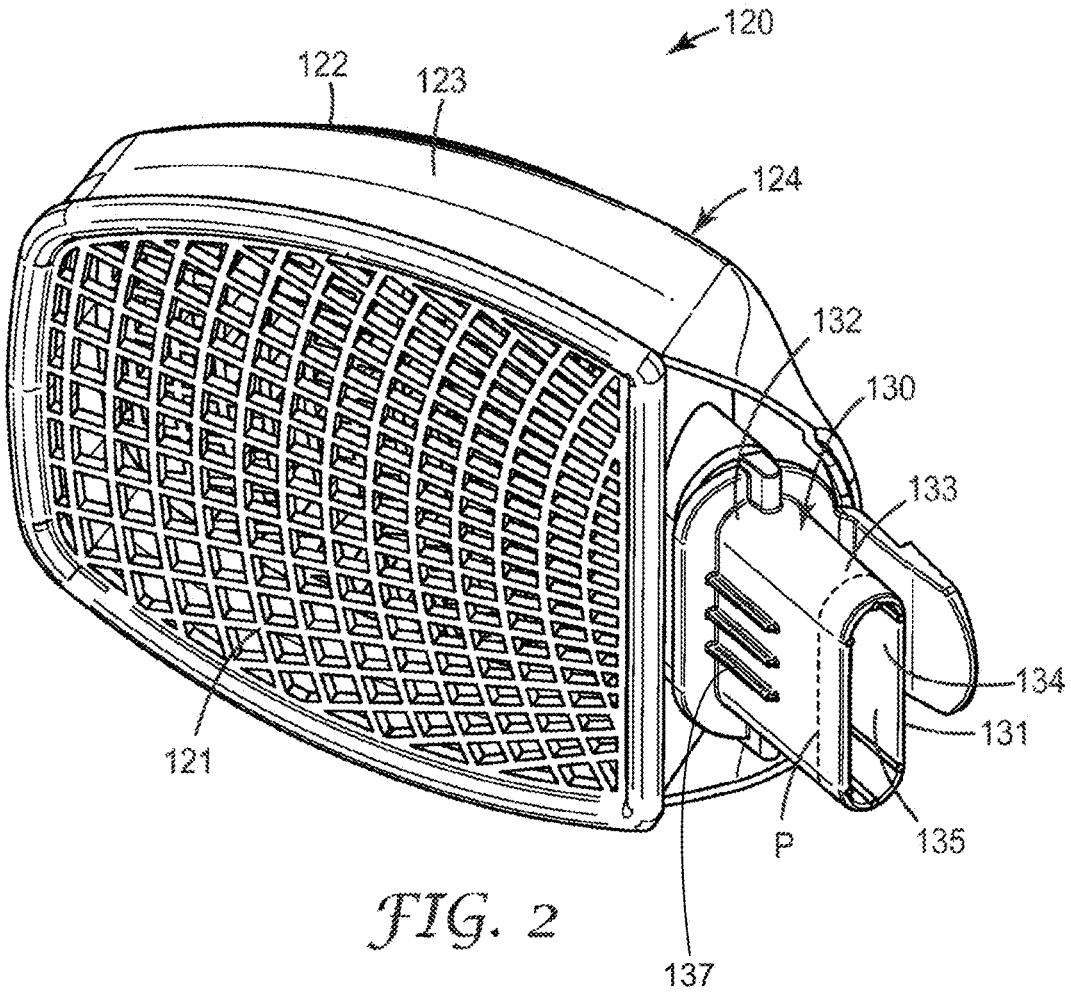
FIG. 2 is a perspective view of an exemplary respirator cartridge according to the present disclosure.

FIG. 2 shows an exemplary filter cartridge 120. Filter cartridge 120 filters ambient air, for example, before it passes into an interior air space between body 110 and the face of a user. In an exemplary embodiment, filter cartridge 120 includes a body portion 124 having first and second major surfaces 121, 122 and a sidewall 123 extending at least partially between first and second major surfaces 121, 122. One or more of first and second major surfaces 121, 122, and/or sidewall 123 are fluid permeable to allow air to enter filter cartridge 120. In some exemplary embodiments, filter cartridge 120 may comprise primarily filter media without an outer housing or surrounded partially by a housing.

Nozzle element 130 extends from a body portion 124 of filter cartridge 120. In an exemplary embodiment, nozzle element 130 is integral to body portion 124 and extends from sidewall 123. In some exemplary embodiments, nozzle element 130 is a separate component that may be releasably or permanently joined to body portion 124. In various exemplary embodiments, nozzle element 130 may extend from first or second major surfaces 121, 122.

In an exemplary embodiment, nozzle element 130 includes a leading end 131, a base end 132, an outer surface 133 and an inner surface 134 opposite outer surface 133. Inner surface 134 defines an airflow channel 135. At any particular location between base end 132 and leading end 131, outer surface 133 has a cross-sectional area (A) bounded by a perimeter (P). In some exemplary embodiments, the shape of nozzle element 130 does not vary between base end 132 and leading end 131 such that perimeter (P) and cross-sectional area (A) are substantially uniform over a length of nozzle element 130. Alternatively, the shape of nozzle element 130 may vary such that, for example, leading end 131 exhibits a smaller perimeter (P) and/or cross-sectional area (A) as compared to a location nearer base end 132. A nozzle element 130 having a slightly smaller leading end 131 may facilitate insertion of nozzle element into receiver 140, as described herein.

Figure 3:
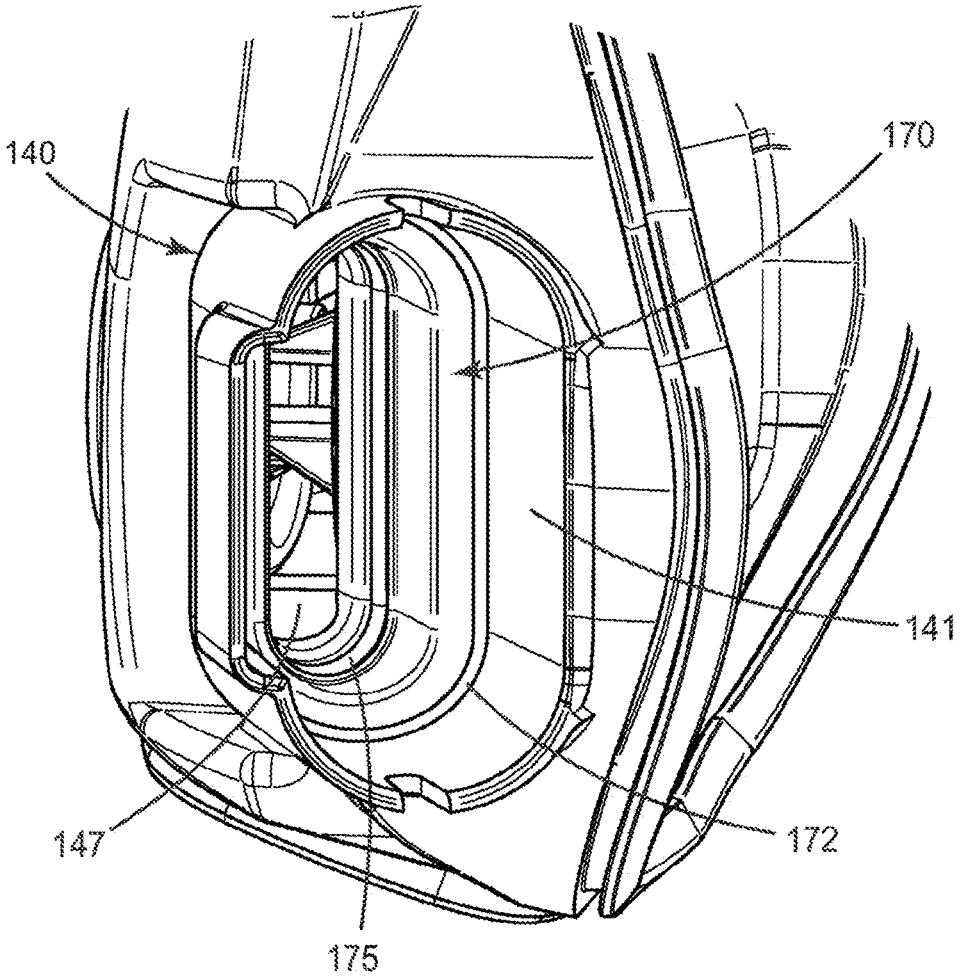
FIG. 3 is a partial view of an exemplary receiver according to the present disclosure.
Figure 4:
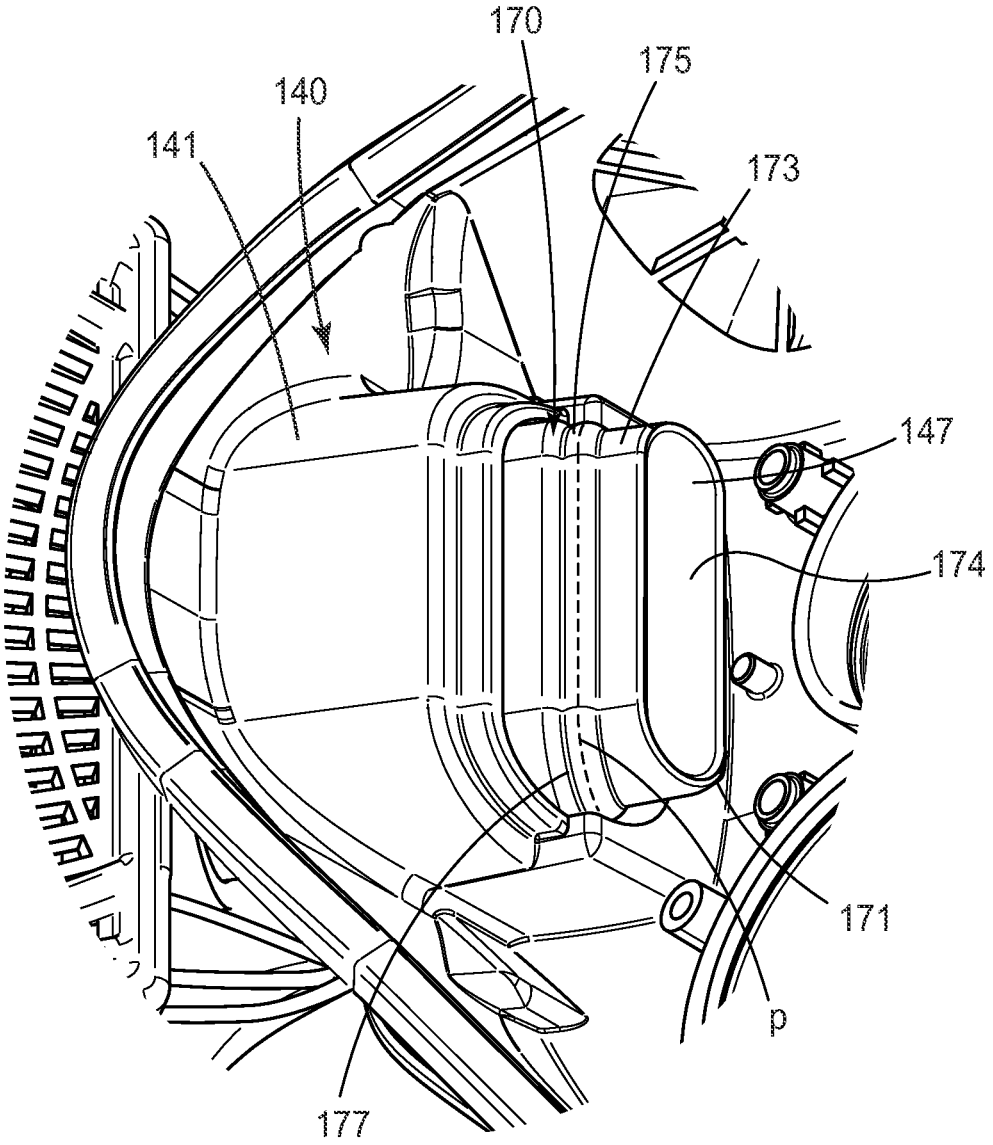
FIG. 4 is a partial view of an exemplary receiver according to the present disclosure.

FIGS. 3 and 4 show an exemplary receiver 140 including a rigid outer portion 141 and an elastomeric sleeve 170. Receiver 140 is configured to engage with filter cartridge 120 such that nozzle element 130 is able to slide into a channel 147 defined by rigid outer portion 141 and elastomeric sleeve 170. In an exemplary embodiment, rigid outer portion 141 may provide primary structural support and stability between body 110 and filter cartridge 120 and elastomeric sleeve 170 provides a seal around nozzle element 130 to prevent ingress of unwanted contaminants or debris from an external environment.

Elastomeric sleeve 170 includes a first end portion 171, a second end portion 172, an outer surface 173 and an inner surface 174 in part defining channel 147, and a longitudinal length (l) (FIG. 5) in the direction of channel 147 between first end portion 171 and second end portion 172. At any particular location along length (l), inner surface 174 defines a cross-sectional area (a) of channel 147 and outer surface 173 defines an outer perimeter (p). In some exemplary embodiments, the shape of elastomeric sleeve 170 does not vary over length (l) such that perimeter (p) and/or cross-sectional area (a) are substantially uniform at any particular location. Alternatively, the shape of elastomeric sleeve 170 may vary over length (l) such that, for example, first end portion exhibits a smaller perimeter (p) and/or cross-sectional area (a) as compared to a location nearer second end portion 172. In an exemplary embodiment, nozzle element 130 is relatively larger than elastomeric sleeve 170 such that an interference occurs when nozzle element 130 is inserted into elastomeric sleeve 170. An elastomeric sleeve 170 having a slightly smaller leading end 131, for example, may facilitate sealing between inner surface 174 and nozzle element 130, as described further herein.

Elastomeric sleeve 170 includes at least a portion that is floating or otherwise not in direct contact with a rigid component that constrains outward elastic deformation or expansion. For example, at least a portion of outer surface 173 is not in direct contact with a rigid component that constrains outward elastic deformation or expansion. In an exemplary embodiment, first end portion 171 is a floating end and is not engaged with a rigid component of body 110. Elastomeric sleeve 170 further includes an intermediate portion 177 that is not backed by a rigid component that could constrain outward elastic deformation or expansion. An elastomeric sleeve including at least a portion not backed by a rigid component allows elastomeric sleeve to flex and/or articulate. Elastomeric sleeve 170 may thus track or follow movement of nozzle element 130 such that a robust seal may be maintained despite possible relative motion between body 110 and filter cartridge 120.

In an exemplary embodiment, elastomeric sleeve 170 includes sections of varying wall thickness and/or having a contoured shape such that elastomeric sleeve 170 includes one or more of a rib 175. Rib 175 may be located at a position of inner surface 174 configured to contact outer surface 133 of nozzle element 130. Rib 175 may facilitate continuous contact with outer surface 133 to provide a desired seal. In an exemplary embodiment, the greatest interference between nozzle element 130 and elastomeric sleeve 170 may be concentrated at the location of rib 175. Providing a limited area of interference may reduce the force a user must exert to engage filter cartridge 120 with body 110 while ensuring a consistent seal.

Figure 5:
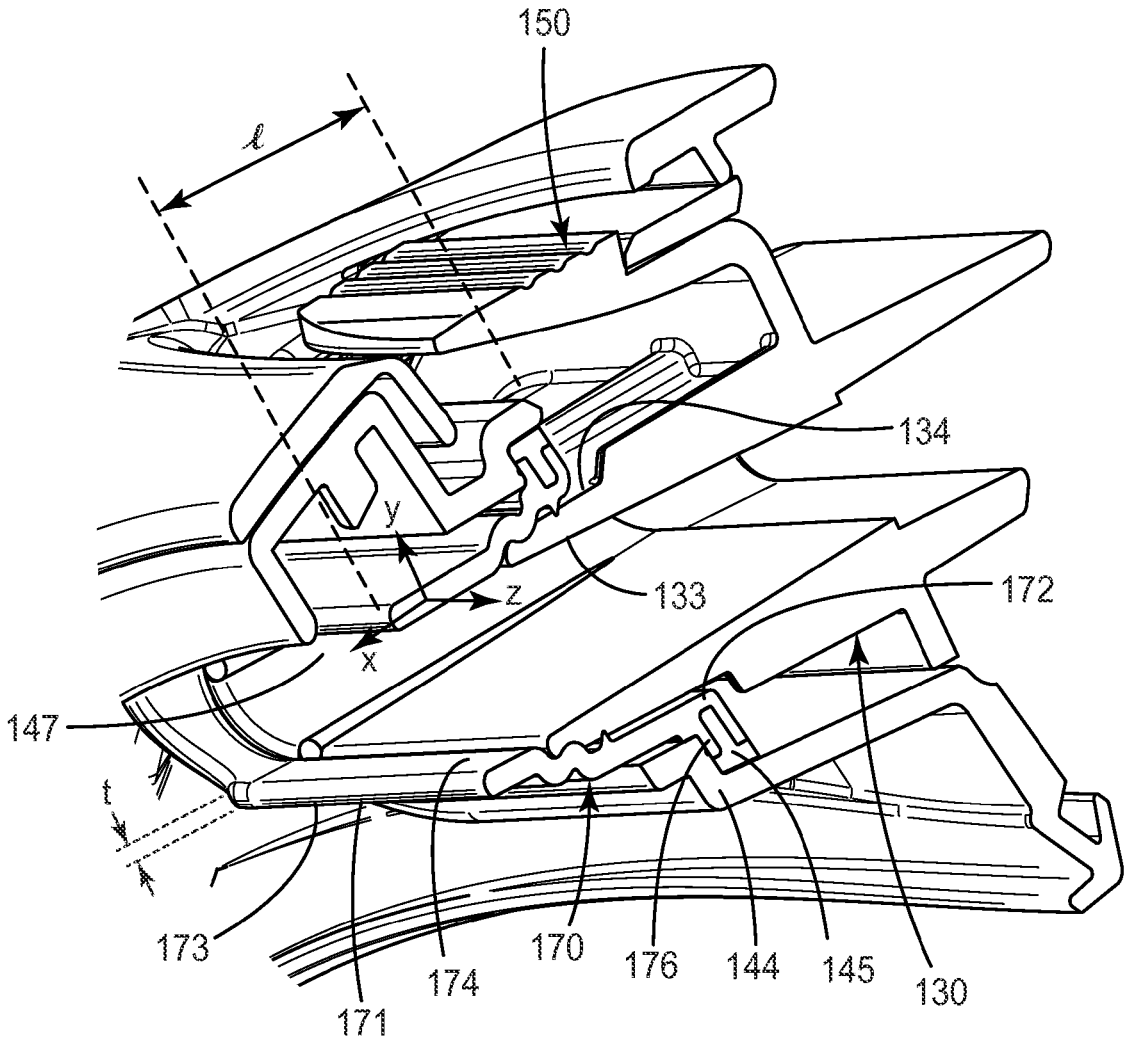
FIG. 5 is a partial sectional view of an exemplary nozzle and receiver according to the present disclosure.

FIG. 5 shows exemplary nozzle element 130 engaged with receiver 140 such that nozzle element 130 is positioned in a channel defined by receiver 140. Elastomeric sleeve 170 is able to conform to outer surface 133 of nozzle element 130 when filter cartridge 120 is inserted into receiver 140. In an exemplary embodiment, insertion of a relatively larger nozzle element 130 into a relatively smaller elastomeric sleeve 170 causes elastomeric sleeve 170 to deform, such as by expanding for example, around outer surface 133 of nozzle element 130. In an exemplary embodiment, elastomeric sleeve expands such that perimeter (p) of outer surface 173 (FIG. 4) and/or cross-sectional area (a) defined by inner surface 174 are larger when nozzle element 130 is positioned in elastomeric sleeve 170 as compared to when nozzle element 130 is not positioned in elastomeric sleeve 170.

Elastic deformation or expansion of elastomeric sleeve 170 around nozzle element 130 results in a restoring force acting to restore elastomeric sleeve to its neutral state. Such a force causes elastomeric sleeve 170 to clamp around outer surface 133 of nozzle element 130 and promote continuous contact between elastomeric sleeve 170 and outer surface 133.

In an exemplary embodiment, elastic deformation or expansion of elastomeric sleeve 170 in a configuration in which at least a portion of elastomeric sleeve 170 is out of contact with a rigid component of body 110 results in a tension around elastomeric sleeve 170, as opposed to compression that may occur if elastomeric sleeve were compressed between nozzle element 130 and a rigid component of body 110, for example. In an exemplary embodiment, elastomeric sleeve 170 exhibits a hoop tension when nozzle element 130 is engaged with receiver 140. In some exemplary embodiments, elastomeric sleeve 170 can be described as having a portion in tension in a direction (z) perpendicular to both an airflow axis (x) and radial thickness (y) of elastomeric sleeve 170.

Elastomeric sleeve 170 is sealingly engaged, directly or indirectly, with a feature of receiver 140 when filter cartridge 120 is engaged with body 110. In an exemplary embodiment, elastomeric sleeve includes a sealing surface 176 that contacts an internal surface or flange 144 of receiver 140. Alternatively or in addition, one or more connectors 145 may sealingly join receiver 140 and elastomeric sleeve. In an exemplary embodiment, sealing surface 176 and connector 145 are positioned adjacent flange 144 such that sealing engagement is promoted by insertion of nozzle element 130 into channel 147. In an exemplary embodiment, elastomeric sleeve 170 and/or connector 145 are permanently joined to body 110. In other exemplary embodiments, elastomeric sleeve 170 and/or connector 145 may be removed and replaced.

Elastomeric sleeve 170 may be made of any suitable material that may repeatedly elastically deform around a filter cartridge. In an exemplary embodiment, elastomeric sleeve 170 is made from a thermoset silicone material such as ELASTOSIL 3003/60A available from Wacker Chemical Corp. of Adrian, Mich. Other suitable materials include thermoplastic vulcanates (TPV), thermoplastic elastomers (TPE), moldable rubbers, urethanes, moldable elastomers, combinations thereof, and other suitable materials as known in the art.

Elastomeric sleeve has a length sufficient to allow a consistent seal around nozzle element 130 while allowing for adequate dimensional tolerance and relative motion between filter cartridge 120 and body 110. In an exemplary embodiment, elastomeric sleeve 170 has a length (l) in a longitudinal direction of channel 147 that is significantly greater than a wall thickness (t) of elastomeric sleeve 170. In various exemplary embodiments, elastomeric sleeve 170 has a length (l) between 6 mm and 14 mm, 8 mm and 12 mm, or of about 10 mm, and wall thickness (t) is between 0.5 mm and 2 mm, 0.75 mm and 1.5 mm, or of about 1.0 mm. In some exemplary embodiments, wall thickness (t) is substantially uniform over length (l) and in other exemplary embodiments wall thickness (t) varies over length (l).

The shape, positioning, and configuration of nozzle element 130 and receiver 140 may be selected to allow filter cartridge 120 to reside close to the face or head of a wearer and to exhibit little or no motion relative to body 110. In an exemplary embodiment, outer surface 133 of nozzle element 130 and rigid outer portion of receiver 140 may exhibit a non-circular shape that prevents rotation between the components. In various embodiments, nozzle element 130 exhibits an elongated oval shape, elliptical shape, irregular shape, circular shape or other suitable shape. An elongated oval shape, for example prevents rotation and facilitates expansion of elastomeric sleeve 170 around nozzle element 130 such that a continuous seal is provided. Nozzle element 130 extends a sufficient distance into receiver 140. Complementary shapes of nozzle element 130 and receiver 140 provide a stable connection and prevent inadvertent disengagement. Sufficient engagement between nozzle element 130 and receiver 140 minimizes relative motion and provides a perception of a robust connection between filter cartridge 120 and body 110.

Filter cartridge 120 and receiver 140 may provide additional features to minimize relative movement between filter cartridge 120 and receiver 140 when engaged. Filter cartridge 120 and receiver 140 may include one or more alignment features, such as protrusions, channels, or other suitable alignment features as known in the art that cooperate to align nozzle element 130 and receiver 140. In an exemplary embodiment, a first alignment feature in the form of a protrusion and a second alignment feature in the form of a channel, slot, or groove, for example, cooperate during engagement of nozzle element 130 and receiver 140. First and second alignment features may assist in aligning nozzle element 130 and receiver 140 during insertion, and securing the components to prevent relative motion when engaged.

Nozzle element 130 may include one or more ribs 137 extending outwardly from outer surface 133. In an exemplary embodiment, ribs 137 may be dimensioned to cooperate with rigid outer portion 141 of receiver 140 to provide a close fit between nozzle element and receiver 140. Ribs 137 may facilitate secure mechanical engagement between nozzle element 130 and receiver 140 without an interference fit over an extended area and thus may limit force exerted by a user when engaging nozzle element 130 to body 110.

Figure 6:
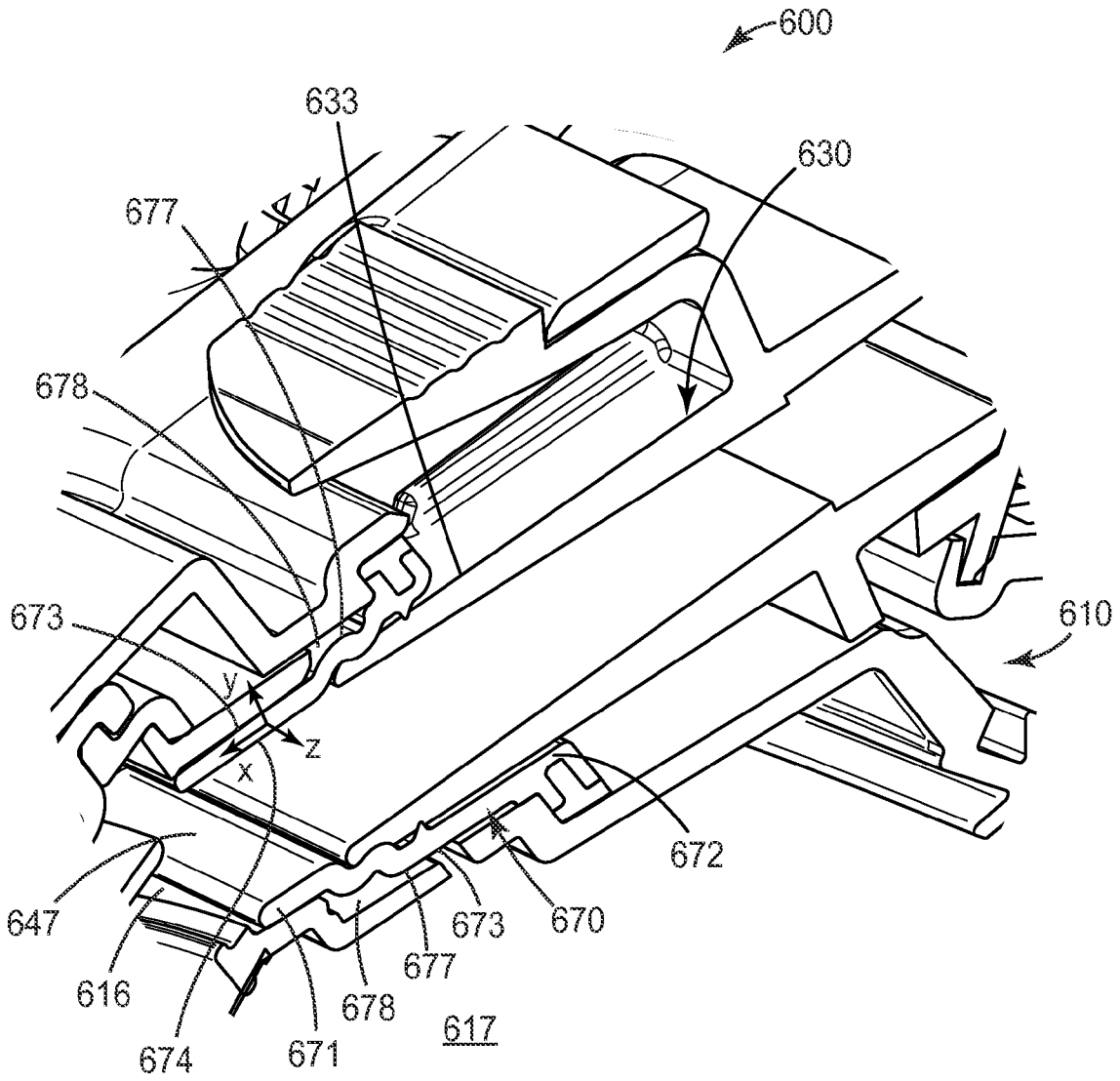
FIG. 6 is a partial sectional view of an exemplary nozzle and receiver according to the present disclosure.

FIG. 6 shows a partial cross-sectional view of another exemplary respiratory device 600. Exemplary respiratory device 600 includes features similar to the features of respirator device 100 described above, and having an elastomeric sleeve 670 including a first end 671 that engages a component of body 610.

In an exemplary embodiment, elastomeric sleeve 670 includes a first end portion 671, a second end portion 672, an outer surface 673 and an inner surface 674 in part defining channel 647. A first end portion 671 engages a component of body 610. In an exemplary embodiment, outer surface 673 contacts, directly or indirectly, one or more interior walls, for example, that divide a first chamber 616 from a second chamber 617 within the interior space defined by body 610.

Elastomeric sleeve 670 includes at least a portion that is floating or otherwise not in direct contact with a rigid component that constrains outward elastic deformation or expansion. In an exemplary embodiment, elastomeric sleeve 670 includes an intermediate portion 677 that is not backed by a rigid component that could constrain outward elastic deformation or expansion. A space 678 is present adjacent outer surface 673 proximate intermediate portion 677. An elastomeric sleeve 670 including at least a portion not backed by a rigid component allows elastomeric sleeve to flex and/or articulate. Elastomeric sleeve 670 may thus track or follow movement of nozzle element 630 such that a robust seal may be maintained despite possible relative motion between body 610 and filter cartridge 620.

Elastomeric sleeve 670 is able to conform to outer surface 633 of nozzle element 630 when filter cartridge 620 is inserted into receiver 640. In an exemplary embodiment, insertion of a relatively larger nozzle element 630 into a relatively smaller elastomeric sleeve 670 causes elastomeric sleeve 670 to elastically deform or expand around outer surface 633 of nozzle element 630. In an exemplary embodiment, elastomeric sleeve expands such that a perimeter (p) of outer surface 673 at intermediate portion 670 and/or cross-sectional area (a) defined by inner surface 674 are larger when nozzle element 630 is positioned in elastomeric sleeve 670 as compared to when nozzle element 630 is not positioned in elastomeric sleeve 670.

Elastic deformation or expansion of elastomeric sleeve 670 around nozzle element 630 results in a restoring force acting to restore elastomeric sleeve to its neutral state. Such a force causes elastomeric sleeve 670 to clamp around outer surface 633 of nozzle element 630 and promote continuous contact between elastomeric sleeve 670 and outer surface 633.

In an exemplary embodiment, expansion of elastomeric sleeve 670 with at least a portion of elastomeric sleeve 670 out of contact with a rigid component of body 610 results in a tension around elastomeric sleeve 670, as opposed to compression that may occur if elastomeric sleeve were compressed between nozzle element 630 and a rigid component of body 610, for example. In an exemplary embodiment, elastomeric sleeve 670 exhibits a hoop tension when nozzle element 630 is engaged with receiver 640. In some exemplary embodiments, elastomeric sleeve 670 can be described as having a portion in tension in a direction (z) perpendicular to both an airflow axis (x) and radial thickness (y) of elastomeric sleeve 670.

A respirator device having an elastomeric sleeve as disclosed herein provides several features and advantages. An elastomeric sleeve including at least a portion that is floating or otherwise not in direct contact with a rigid component that constrains outward expansion provides significant advantages in creating a seal between a nozzle element and body of a respiratory protection device. Elastomeric sleeve may flex and articulate and thus maintain sealing contact with a nozzle element even if the nozzle element moves or articulates relative to the receiver. Further, an elastomeric sleeve as disclosed herein provides an adequate seal while minimizing insertion force required by a user. A filter cartridge may be easily inserted into a receiver to create a secure connection without rotation. The force exerted by a user during insertion to cause elastomeric sleeve to expand around a nozzle element may be minimal as compared to a force required if a seal were formed by compressing a sealing element against a rigid backing component, for example.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures. Any feature or characteristic described with respect to any of the above embodiments can be incorporated individually or in combination with any other feature or characteristic, and are presented in the above order and combinations for clarity only.

The invention claimed is:

1. A respirator device, comprising:

a body comprising a receiver having an elastomeric sleeve and a rigid outer portion, wherein the receiver defines an aperture in the body, wherein the rigid outer portion is proximate the aperture and, the elastomeric sleeve is adjacent the rigid outer portion such that the rigid outer portion is positioned between the aperture and the elastomeric sleeve; and a rigid nozzle element having an outer surface;

wherein inner surfaces of each of the elastomeric sleeve and the rigid outer portion define a channel extending from the aperture, wherein the elastomeric sleeve is configured to deform around the outer surface of the nozzle element when the nozzle element is inserted into the channel, and wherein the outer surface of the nozzle element defines a non-circular shape that prevents rotation between the nozzle element and the rigid outer portion when the nozzle element is inserted into the channel.

2. The respirator device of claim 1, further comprising a filter cartridge, the rigid nozzle element joined to the filter cartridge.

3. The respirator device of claim 1, wherein the elastomeric sleeve comprises an outer surface opposite the inner surface, the inner surface defining the channel, and at least a portion of the outer surface out of contact with a rigid component.

4. The respirator device of claim 1, wherein the elastomeric sleeve is in hoop tension when the nozzle element is inserted into the channel.

5. The respirator device of claim 1, wherein the elastomeric sleeve is in tension in a direction perpendicular to an airflow axis and a radial thickness of the elastomeric sleeve when the nozzle element is inserted into the channel.

6. The respirator device of claim 1, wherein the elastomeric sleeve has a first end portion and a second end portion, and the first end portion is a floating end.

7. The respirator device of claim 1, wherein the elastomeric sleeve has a first end portion and a second end portion, the body includes an interior wall dividing a first chamber and second chamber of an interior space of the body, and the first end portion of the elastomeric sleeve contacts the interior wall.

8. The respirator device of claim 1, wherein the elastomeric sleeve has a first end portion and a second end portion, and the second end portion is sealingly engaged with the body.

9. The respirator device of claim 1, wherein the elastomeric sleeve comprises an outer surface having a perimeter (p), and the perimeter (p) is larger when the nozzle element is inserted in the channel.

10. The respirator device of claim 1, wherein the elastomeric sleeve comprises a first end, a second end, and an outer surface having a perimeter (p), the perimeter (p) varying between the first and second ends.

11. The respirator device of claim 1, wherein the channel defined by the elastomeric sleeve includes a rib around a perimeter of an inner surface.

12. The respirator device of claim 1, wherein the elastomeric sleeve is made from a thermoset material.

13. The respirator device of claim 1, wherein the elastomeric sleeve is made from a silicone.

14. The respirator device of claim 1, wherein the elastomeric sleeve is made from a material selected from the group consisting of injection moldable (high or low pressure) elastomers.

15. The respirator device of claim 1, wherein the elastomeric sleeve has a length (l) in a longitudinal direction between 6 mm and 12 mm.

16. The respirator device of claim 1, wherein the elastomeric sleeve has a wall thickness (t) between 0.5 mm and 2 mm.

17. The respirator device of claim 1, wherein the body is a half-mask body.

18. The respirator device of claim 1, wherein the body is a full-mask body.

19. The respirator device of claim 1, wherein the body is a head-mounted respirator device body.

20. The respirator device of claim 1, wherein the body is a housing of a powered air respirator device.

21. A respirator device, comprising:

a body comprising a receiver having an elastomeric sleeve and a rigid outer portion, wherein the elastomeric sleeve is engaged with and extends from the rigid outer portion; and a rigid nozzle element having a leading end, a base end, and an outer surface;

wherein inner surfaces of each of the elastomeric sleeve and the rigid outer portion define a channel, wherein the elastomeric sleeve is configured to deform around the outer surface of the nozzle element when the nozzle element is inserted into the channel, and wherein the base end of the nozzle element is closer to the inner surface of the rigid outer portion than the inner surface of the elastomeric sleeve and the leading end of the nozzle element is closer to the inner surface of the elastomeric sleeve than the inner surface of the rigid outer portion.

* * * * *